US006162339A

United States Patent [19]

Salman et al.

[11] Patent Number: 6,162,339

[45] Date of Patent: Dec. 19, 2000

[54] TWO COAT E-COAT PROCESS FOR AUTOMOTIVE BODIES

[75] Inventors: Syed Salman, Troy; Shamel T. Rushwin; Thomas R. Breneiser, both of Rochester Hills; Richard H. Ott, Brighton, all of Mich.

[73] Assignee: DaimlerChrysler Corporation, Auburn Hills, Mich.

[21] Appl. No.: 09/293,675

[22] Filed: Apr. 16, 1999

[51] Int. Cl.[7] ..... C25D 13/00

[52] U.S. Cl. ..... 204/484; 489/509

[58] Field of Search ..... 204/484, 489, 204/509

[56] References Cited

U.S. PATENT DOCUMENTS

| | | | |
|---|---|---|---|
| 4,402,983 | 9/1983 | Craven | 428/353 |
| 4,456,507 | 6/1984 | Kivel et al. | 204/181 T |
| 4,598,020 | 7/1986 | Panush | 428/411.1 |
| 4,756,975 | 7/1988 | Fujii et al. | 428/461 |
| 4,844,955 | 7/1989 | Graefe et al. | 428/420 |
| 4,974,307 | 12/1990 | Uebayashi et al. | 29/460 |
| 4,988,420 | 1/1991 | Batzill et al. | 204/484 |
| 5,203,975 | 4/1993 | Richardson | 204/484 |
| 5,227,200 | 7/1993 | LeGrow | 428/387 |
| 5,348,634 | 9/1994 | Matsuo et al. | 204/181.1 |
| 5,385,656 | 1/1995 | Doebler et al. | 204/181.1 |
| 5,405,894 | 4/1995 | Best | 524/166 |
| 5,427,822 | 6/1995 | Bracciano | 427/424 |
| 5,552,227 | 9/1996 | Göldner | 427/409 |
| 5,556,527 | 9/1996 | Igarashi et al. | 204/488 |
| 5,597,861 | 1/1997 | Nakae et al. | 524/601 |
| 5,741,552 | 4/1998 | Takayama et al. | 427/410 |
| 5,830,541 | 11/1998 | Carswell et al. | 427/475 |
| 5,830,580 | 11/1998 | Flammer et al. | 428/461 |

*Primary Examiner*—Kishor Mayekar
*Attorney, Agent, or Firm*—Roland A. Fuller, III

[57] ABSTRACT

A method for priming an object with through electrodeposition. The object is initially immersed into a first tank having a first primer bath and a first primer layer is electrodeposited onto the object. The object is removed from the first primer bath and cured to a first predetermined level. The object is then immersed into a second tank having a second primer bath and a second primer layer is electrodeposited onto the object. The object is removed from the second primer bath and cured to a second predetermined level. The primer baths are preferably formulated differently so as to achieve a multi-layer prime coat having several characteristics which would not otherwise be possible if the primer layer was created in one electrodeposition step.

3 Claims, 1 Drawing Sheet

TWO COAT E-COAT PROCESS FOR AUTOMOTIVE BODIES

BACKGROUND OF THE INVENTION

1. Technical Field

The present invention relates generally to automotive paint finishing processes and more particularly to an improved priming method.

2. Discussion

The paint finish on a new vehicle is often regarded as the single most noticeable visual feature of the vehicle. When the finish is smooth, even and attractive, persons viewing the vehicle are likely to be influenced as to the quality of the vehicle in a positive manner. Conversely, when the paint finish contains defects, persons viewing the vehicle are likely to attribute a lack of quality to the vehicle generally. Accordingly, vehicle manufacturers and paint suppliers have expended vast resources to produce enhanced paint application processes to improve the quality and durability of the finish of the vehicle and eliminate defects associated with the application of paint to the vehicle.

Despite these efforts, significant improvements relating to process of vehicle priming have not been made. Typical prior art priming methods have included a first coat of paint that is applied through electrodeposition in which a cathodic or anodic type primer (e-coat primer) is applied to the body of the vehicle. As these electrodeposited primers are susceptible to degradation by ultraviolet light, their use increased the risk of a delamination. More specifically, extended exposure to ultraviolet light would penetrate the e-coat primer, causing it to delaminate from the vehicle body. Since each subsequent coat of paint on the vehicle body is essentially bonded to the previous coat of paint, the delamination of the primer from the vehicle body creates a catastrophic failure in the vehicle finish wherein the entire finish is lost over the area of the failure.

To reduce the risk of delamination failures, a second primer coat, traditionally a solvent or water-based paint which is resistant to ultraviolet light, has been sprayed over the first primer coat. In recent years, powder primers were developed to replace the liquid paints due to environmental considerations and also because powder paints are stronger and more durable, thus providing improved chip resistance. Despite the apparent success of liquid and powder paints for a second primer coat, their use is attendant with several significant drawbacks.

While both liquid and powder paints can be applied with automatic equipment, it is frequently necessary to include one or more manual "touch-up" stations which are operated with production personnel. Frequently, these manual stations operate at low utilization and the quality of the finish is highly dependent on the skill of the personnel operating the station. Both types of paint also include costly capital equipment for applying the paint as well as controlling the environment in which the paint is applied to the vehicle body.

Another significant drawback concerns the robustness of the processes for applying these paints. A myriad of factors contributes to the overall quality of the finish of vehicle bodies painted with either powder or liquid paint. Small deviations in temperature, humidity, airflow, paint viscosity, etc. can have significant effects on the quality of the finish. As such, the use of these types of paint requires the continuous monitoring and control of a multitude of process variables. Naturally, the cost to continually monitor and control the process variables is considerable.

Therefore, there remains a need in the art for an improved priming method which provides a more robust priming process which can be entirely automated and which does not require additional equipment to apply powder or solvent or water based liquid paints.

SUMMARY OF THE INVENTION

It is therefore one object of the present invention to provide an improved method for priming automotive vehicle bodies.

It is a more specific object of the present invention to provide a method for priming automotive vehicle bodies through the electrodeposition of multiple coats of paint.

It is another object of the present invention to provide a method for priming automotive vehicle bodies through electrodeposition with at least one primer coat, that is resistant to ultraviolet light.

It is still another object of the present invention to provide a method for priming automotive vehicle bodies through electrodeposition with at least one coat that provides improved chip resistance.

Briefly, the present invention comprises a method for priming an object through electrodeposition. The object is initially primed with a first prime coat in which the object is immersed into a first tank having a first primer bath. The solution in the first primer bath is formulated to provide corrosion protection and adhere to the object to provide a proper foundation for the subsequently applied coats of paint. The object is removed from the first primer bath and cured. The object is then primed with a second prime coat in which the object is immersed into a second tank having a second primer bath. The solution is the second primer bath is formulated to adhere to the first prime coat, provide a proper foundation for any subsequently applied paint and provide protection against ultraviolet light and chipping. Because the priming process is completely performed by electrodeposition, application is completely automated and requires no additional equipment to apply powder or water or solvent based liquid paints.

The method of the present invention provides an improved priming process which is extremely robust and capable, is environmentally friendly. The method is also less costly than other priming methods due to the elimination of manual labor to apply the paint, lower facilities and equipment costs and reduced maintenance costs. The method is also more tolerant to changes in production rates.

Additional advantages and features of the present invention will become apparent from the subsequent description and the appended claims, taken in conjunction with the accompanying drawings.

DETAILED DESCRIPTION OF THE PREFERRED EMBODIMENT

Figure 1:
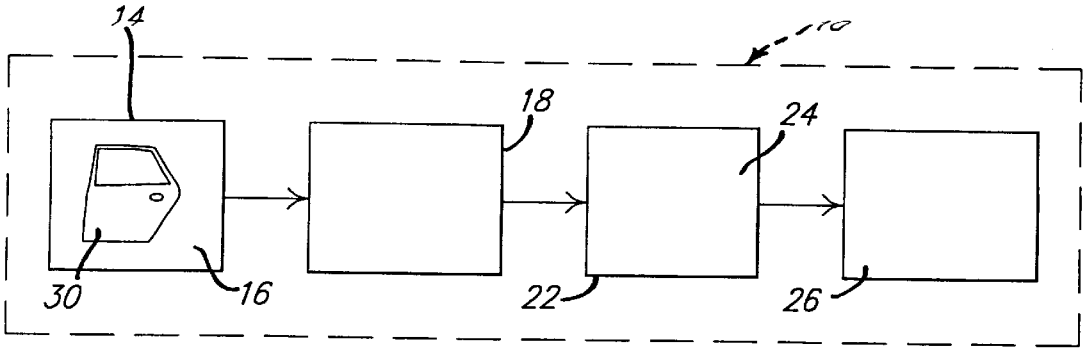
FIG. 1 is a schematic view of an exemplary automotive priming system incorporating the method of the present invention.

With reference to FIG. 1 of the drawings, a paint system for priming an object in accordance with the teachings of the present invention is generally indicated by reference numeral 10. Paint system 10 includes a first electrodeposition tank 14 having a first primer 16, a first curing area 18, a second electrodeposition tank 22 having a second primer 24 and a second curing area 26. It will be understood that although the particular embodiment illustrated pertains to the application of a multi-layer prime coat to an automotive vehicle body, the method of the present invention has applicability to other objects in which a multi-layer prime coat created through electrodeposition is desired.

Figure 2:
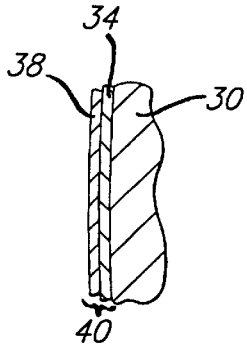
FIG. 2 is a cross-sectional view of a portion of a vehicle body primed by the method of the present invention.

A vehicle body 30 entering paint system 10 is initially immersed into the first primer 16 in the first electrodeposition tank 14. A first primer layer 34, as shown in FIG. 2, is applied by electrodeposition and the vehicle body 30 is removed to the first curing area 18 where the first primer layer 34 is cured (i.e., dehydrated) to a predetermined level. The vehicle body 30 is then immersed into the second primer 24 in the second electrodeposition tank 22. A second primer layer 38, also shown in FIG. 2, is applied by electrodeposition and the vehicle body 30 is removed to the second curing area 26 where the second primer layer 38 is cured to a predetermined level. While the first and second primers 16 and 24 may be formulated identically, they are each preferably formulated to provide distinct characteristics which would not be attainable if the prime coat were applied in a single electrodeposition step. In the example illustrated, the first primer 16 is formulated to adhere to and provide corrosion resistance for the metallic structure of the vehicle body 30, while the second primer 24 is formulated to provide improved resistance to ultraviolet light and chipping.

Figure 3:
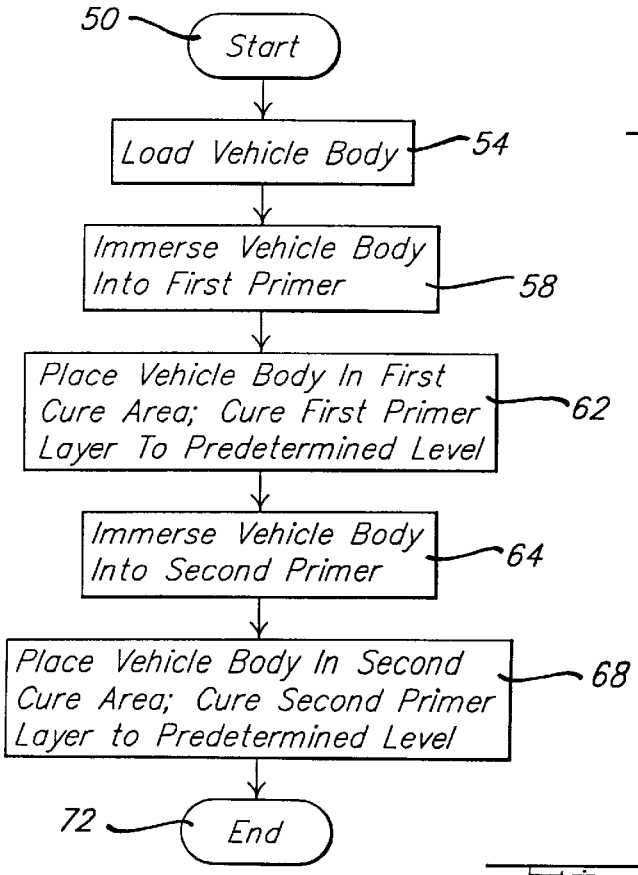
FIG. 3 is a flow chart depicting the priming method of the present invention.

With reference to FIG. 3, the method of the present invention is shown in flowchart form. The methodology is entered at bubble 50 and proceeds to block 54 where a vehicle body 30 is loaded into paint system 10. The methodology proceeds to block 58 where the vehicle body 30 is immersed into the first primer 16 in the first electrodeposition tank 14. The first primer 16 is preferably an epoxy resin based paint, such as ED-7151 sold by PPG, having the following properties:

- bath solids (% by weight) within a range of 19 to 25%, and preferably from 21 to 23%;
- bath pH from 5.9 to 6.1, and preferably 6.0;
- bath conductivity from 1300 to 1600 $\mu$S (microohms), and preferably from 1400 to 1550 $\mu$S;
- total solvent (% by weight) from 1.3 to 1.7%, and preferably from 1.4 to 1.6%;
- bath temperature from 85 to 100 degrees F., and preferably 90 degrees F. The vehicle body 30 is subjected to approximately 180 to 230 volts while immersed in the first primer 16 to electrodeposit a first primer layer 34 having a wet film thickness of approximately 0.75 mil.

The methodology then proceeds to block 62 where the vehicle body 30 is removed from the first electrodeposition tank 14 and placed in the first cure area 18. The first cure area 18 is maintained at a temperature of approximately 300 to 450 degrees C. and preferably 350–400 degrees C. The vehicle body 30 remains in the first cure area 18 until the first primer layer 34 has cured to a predetermined level which depends upon a number of factors including the characteristics of the second primer 24. As such, it will be understood that the predetermined cure level may range between 0% dehydration to 100% dehydration (i.e., fully cured). In the particular embodiment illustrated, the vehicle body 30 remains in the first cure area 18 for approximately 30 minutes until the first primer layer 34 is fully cured. The thickness of the first primer layer 34 when fully cured is approximately 18 to 20 microns thick.

The methodology next proceeds to block 64 where the vehicle body 30 is immersed into the second primer 24 in the second electrodeposition tank 24. The second primer 24 is preferably a urethane-based paint, such as ED-8100 sold by PPG, having the following properties:

- bath solids (% by weight) within a range of 5 to 15%, and preferably from 10 to 14%;
- bath pH from 5.2 to 5.6, and preferably 5.4;
- bath conductivity from 500 to 700 $\mu$S, and preferably from 575 to 625 $\mu$S;
- total solvent (% by weight) from 0.1 to 0.3%, and preferably from 0.1 to 0.2%;
- bath temperature from 95 to 100 degrees F., and preferably 95 degrees F. The vehicle body 30 is subjected to approximately 250 to 300 volts while immersed in the second primer 24 to electrodeposit a second primer layer 38 having a wet film thickness of approximately 1.4 mils.

The methodology then proceeds to block 68 where the vehicle body 30 is removed from the second electrodeposition tank 22 and placed in the second cure area 26. The second cure area 26 is maintained at a temperature of approximately 275 to 425 degrees C. and preferably 325–375 degrees C. The vehicle body 30 remains in the second cure area 26 until the second primer layer 38 has cured to a predetermined level which depends upon a number of factors including the characteristics of any paint which would be applied over the second primer layer 38 and the time interval between paint applications. As such, it will be understood that the predetermined cure level may range between 0% dehydration to 100% dehydration (i.e., full cured). In the particular embodiment illustrated, the vehicle body 30 remains in the second cure area 26 for approximately 30 minutes until the second primer layer 38 is fully cured (i.e., completely dehydrated). The thickness of the second primer layer 38 when fully cured is approximately 35 to 38 microns thick. The methodology then proceeds to bubble 72 where the methodology terminates. Ideally, the vehicle body is then processed through a finishing operation to apply one or more top coats of paint in a manner well known in the art.

The process described above is advantageous for several reasons. Most importantly, the process provides a multi-layer prime coat that resists corrosion, ultra-violet light degradation and chipping. Additionally, the multi-layer prime coat provided by the method of the present invention has superior adhesion characteristics and as such, provides a superior foundation for any top coats of paint which are subsequently applied to the vehicle body. The process of the present invention provides a multi-layer prime coat with minimal labor efforts. Thus, a superior multi-layer prime coat is obtained in an efficient and cost effective manner, which produces extremely reliable and repeatable results.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A method for forming an ultra-violet light and chip resistant primer finish on an object comprising the steps of:

immersing said object into a first primer formed from an epoxy resin based paint;

electrodepositing a first primer layer onto said object;

curing said first primer layer at a temperature of about 300° C. to about 450° C. until said first primer layer is completely dehydrated;

immersing said object into a second primer formed from an urethane based paint;

electrodepositing a second primer layer onto said cured object; and curing said second primer layer at a temperature of about 275° C. to about 425° C. until said second primer layer is completely dehydrated.

2. The method of claim 1 wherein said step of curing said first primer layer is performed at a temperature of approximately 350–400 degrees C.

3. The method of claim 1 wherein said step of curing said second primer layer is performed at a temperature of approximately 325–375 degrees C.

* * * * *